US012509812B2

(12) United States Patent
James et al.

(10) Patent No.: US 12,509,812 B2
(45) Date of Patent: Dec. 30, 2025

(54) LAUNDRY APPLIANCE CONTROL PANEL WITH SINGLE HANDLE RECESS FOR MULTIPLE DRAWERS

(71) Applicant: Haier US Appliance Solutions, Inc., Wilmington, DE (US)

(72) Inventors: Alexander Daniel James, Crestwood, KY (US); David Scott Dunn, Louisville, KY (US); Aaron Daniel Abbott, Louisville, KY (US); Kenneth G. Rudolph, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 197 days.

(21) Appl. No.: 18/306,743

(22) Filed: Apr. 25, 2023

(65) Prior Publication Data

US 2024/0360610 A1 Oct. 31, 2024

(51) Int. Cl.
*D06F 34/28* (2020.01)
*D06F 105/58* (2020.01)

(52) U.S. Cl.
CPC ..... *D06F 34/28* (2020.02); *D06F 2105/58* (2020.02)

(58) Field of Classification Search
CPC ..... D06F 34/28; D06F 2105/58; D06F 25/00; D06F 58/22; D06F 29/02
See application file for complete search history.

(56) References Cited

U.S. PATENT DOCUMENTS

| | | | | |
|---|---|---|---|---|
| 9,290,885 | B2 | 3/2016 | Kim et al. | |
| 2007/0151302 | A1* | 7/2007 | Kendall | D06F 29/005 68/3 R |
| 2017/0139490 | A1* | 5/2017 | Morandini | D06F 34/28 |
| 2017/0254013 | A1 | 9/2017 | Pratt | |
| 2023/0084319 | A1* | 3/2023 | Dunn | D06F 25/00 68/12.15 |

FOREIGN PATENT DOCUMENTS

| | | | |
|---|---|---|---|
| EP | 2843123 | B1 | 6/2022 |
| KR | 100959526 | B1 | 5/2010 |
| KR | 20140058763 | A | 5/2014 |
| WO | WO2022022170 | A1 | 2/2022 |

OTHER PUBLICATIONS

WO 2022022170 A1 machine translation, Integrated Washer-Dryer, Liu (Year: 2022).*

* cited by examiner

*Primary Examiner* — Cristi J Tate-Sims
(74) *Attorney, Agent, or Firm* — Dority & Manning, P.A.

(57) ABSTRACT

A laundry appliance having a front panel with a single handle recess for multiple drawers is provided. The appliance includes a drawer assembly adjacent to a control panel on a cabinet. Two drawers are vertically stacked, each forming a vertical edge. A third drawer is positioned between the stacked drawers and the control panel and forms a third vertical edge spaced apart from the first and second vertical edges. The first, second, and third vertical edges define a common recessed handle area for manipulating the first, second, and third drawers.

20 Claims, 8 Drawing Sheets

LAUNDRY APPLIANCE CONTROL PANEL WITH SINGLE HANDLE RECESS FOR MULTIPLE DRAWERS

FIELD OF THE INVENTION

The present disclosure relates generally laundry appliances, in particular to front load washing machines and combination washer/dryer machines.

BACKGROUND OF THE INVENTION

Known front load laundry appliances (i.e., horizontal axis laundry appliances) may have receptacles for accepting laundry additives, such as detergent, bleach, fabric softeners, scent packets, and the like. Typically, the laundry additive receptacles are large enough for one laundry load. Repeated transport of laundry additives to fill a single-use volume is tiresome and can lead to multiple spills. Accordingly, a drawer system with a plurality of drawers accepting laundry additives for multiple loads would be beneficial.

BRIEF DESCRIPTION OF THE INVENTION

Aspects and advantages of the invention will be set forth in part in the following description, may be apparent from the description, or may be learned through practice of the invention.

In one exemplary aspect, a horizontal axis laundry appliance is disclosed, the horizontal axis laundry appliance comprising a cabinet having a front panel defining an opening, a drum positioned within the cabinet and being accessible through the opening, and a door mounted to the cabinet and movable between an open position and a closed position to provide selective access to the drum through the opening. A control panel is mounted to a front of the cabinet, and a drawer assembly is positioned adjacent to the control panel, the drawer assembly comprising a plurality of drawers. The drawer assembly further comprises at least a first drawer and a second drawer of the plurality of drawers stacked in the vertical direction, the first drawer stacked atop the second drawer, the first drawer of the stacked drawers defining a first vertical edge and the second drawer of the stacked drawers defining a second vertical edge. At least a third drawer of the plurality of drawers is positioned between the stacked drawers and the control panel, the third drawer defining a third vertical edge spaced apart from the first vertical edge and the second vertical edge to define a common recessed handle area.

In another example aspect, a front panel for a laundry appliance is disclosed, the front panel comprising an inner surface and an opposite outer surface, a control panel on the front panel, and a drawer assembly positioned adjacent to the control panel, the drawer assembly comprising a plurality of drawers. The drawer assembly further comprises at least a first drawer and a second drawer of the plurality of drawers stacked in a vertical direction, the first drawer stacked atop the second drawer, the first drawer of the stacked drawers defining a first vertical edge and the second drawer of the stacked drawers defining a second vertical edge. At least a third drawer of the plurality of drawers is positioned between the stacked drawers and the control panel, the third drawer defining a third vertical edge spaced apart from the first vertical edge and the second vertical edge to define a common recessed handle area.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
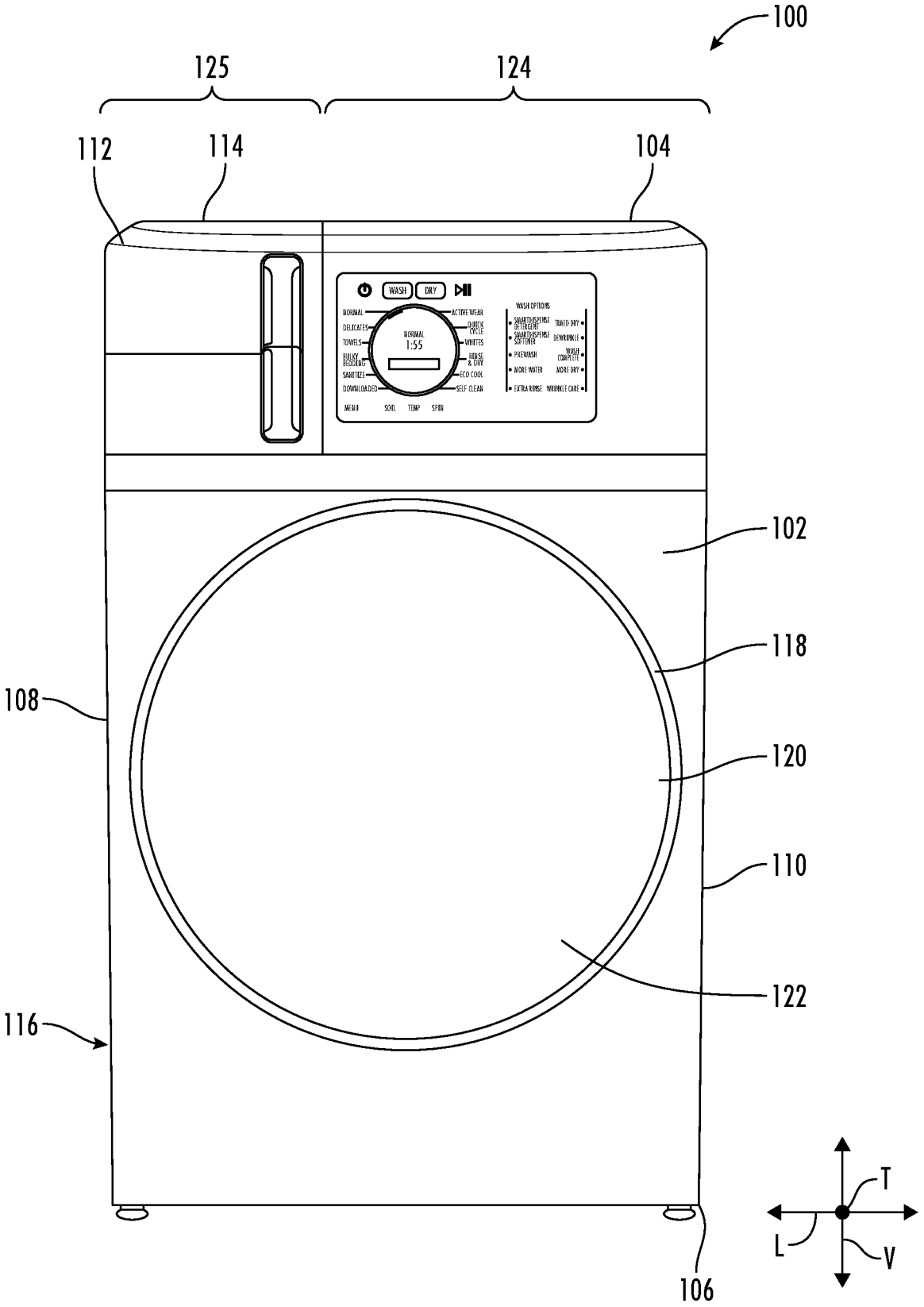
FIG. 1 provides a front view of a horizontal axis laundry appliance in accordance with an embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

As used herein, "behind" generally means directed to the rear of, while "in front" and similar forms generally means towards the front of, as both expressions are generally understood. "Horizontal" is generally used to refer to an orientation parallel to the lateral L and transverse T directions, or in a plane formed by the lateral and transverse directions.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the figures, an exemplary laundry appliance will be described in accordance with aspects of the present subject matter. Specifically, FIG. 1 provides a perspective view of an exemplary laundry appliance 100. As illustrated, laundry appliance 100 generally defines a vertical direction V, a lateral direction L, and a transverse direction T, each of which is mutually perpendicular, such that an orthogonal coordinate system is generally defined. The vertical direction V, a lateral direction L, and a transverse direction T similarly apply to the front panel 116.

According to exemplary embodiments, laundry appliance, appliance 100 includes a cabinet 102 that is generally configured for containing and/or supporting various components of appliance 100 and which may also define one or more internal chambers or compartments of appliance 100. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing appliance 100.

The cabinet 102 includes a front panel 116 including an interior edge 118 defining an opening 120. A door 122 is mounted to the cabinet 102 and movable between an open position (not shown) and a closed position (FIG. 1) to provide selective access to the opening 120. For example, a drum (not shown) may be positioned within the cabinet 102 for receipt and processing of laundry articles. Door 122 may provide selective access to the drum through the opening 120, for example to seal the drum during processing and provide access to the drum to load and unload laundry articles.

A front control panel 124 is positioned vertically above the opening 120, generally adjacent to the top 104 of the cabinet 102. The control panel 124 includes a user interface 126 for user selection of appliance laundry cycles and features. For example, in one embodiment, a display on the user interface 126 indicates selected features, a countdown timer, and/or other data items of interest to laundry appliance 100 users.

Operation of laundry appliance 100 is controlled by a controller or processing device, user interface board 130 (FIG. 2) that is operatively coupled to user interface 126 and input selectors 128 for user manipulation to select laundry appliance cycles and features. In response to user manipulation of control panel 124 and input selectors 128, user interface board 130 operates the various components of laundry appliance 100 to execute selected machine cycles and features.

Laterally spaced from the user interface 126 is a plurality of drawers, three shown in the figures, first drawer 132, second drawer 134, and third drawer 136, comprising a drawer assembly 125. In other embodiments, more drawers could be used for drawer assembly 125 without deviating from this disclosure. As illustrated, first and second drawers 132, 134 are stacked, the first drawer 132 vertically atop the second drawer 134 at the first side 108 of the control panel 124, with the third drawer 136 positioned between the stacked drawers 132, 134 and the user interface 126. In other embodiments, the stacked drawers 132, 134 may be on the second side 110 of the control panel, the user interface positioned at the first side 108 and the third drawer 136 positioned between the two stacked drawers 132, 134 and the user interface 126. In other words, drawer assembly 125 could be on the second (right) side 110 of the laundry appliance and user interface 126 on the first (left) side 108.

Figure 2:
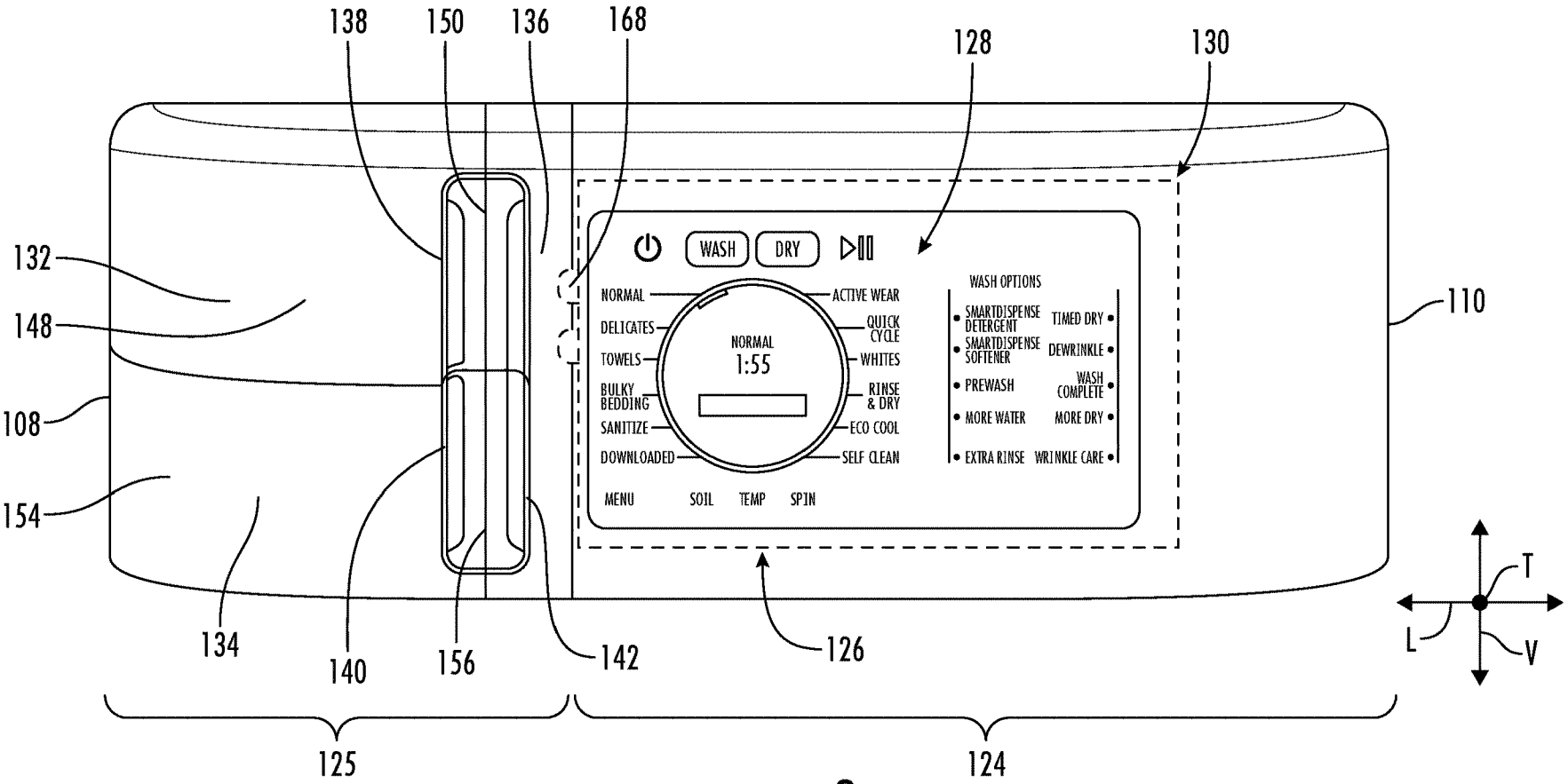
FIG. 2 provides an enlarged view of the front panel of the laundry appliance of FIG. 1.
Figure 3:
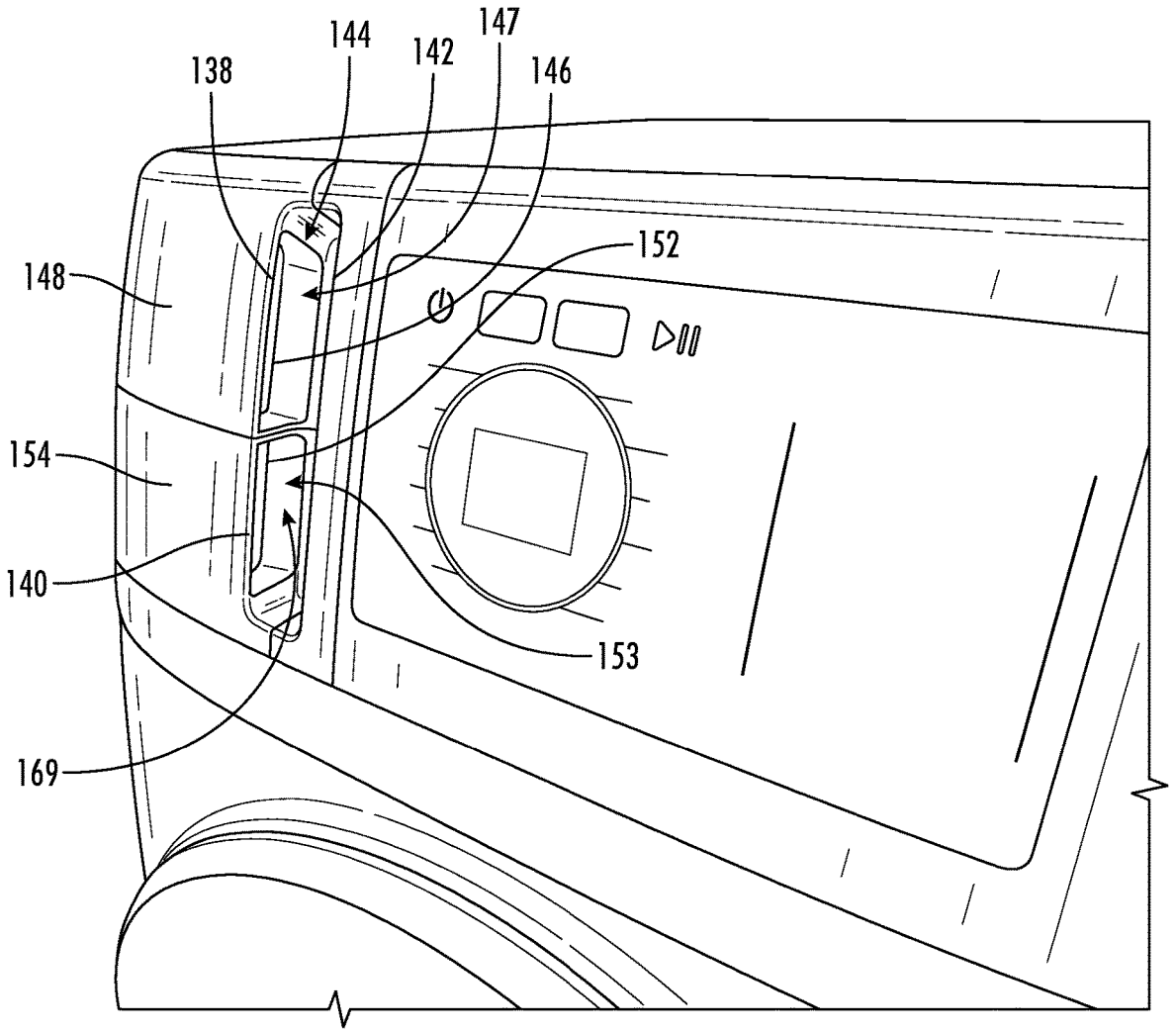
FIG. 3 provides a perspective view of the control panel of the laundry appliance of FIG. 1.
Figure 4:
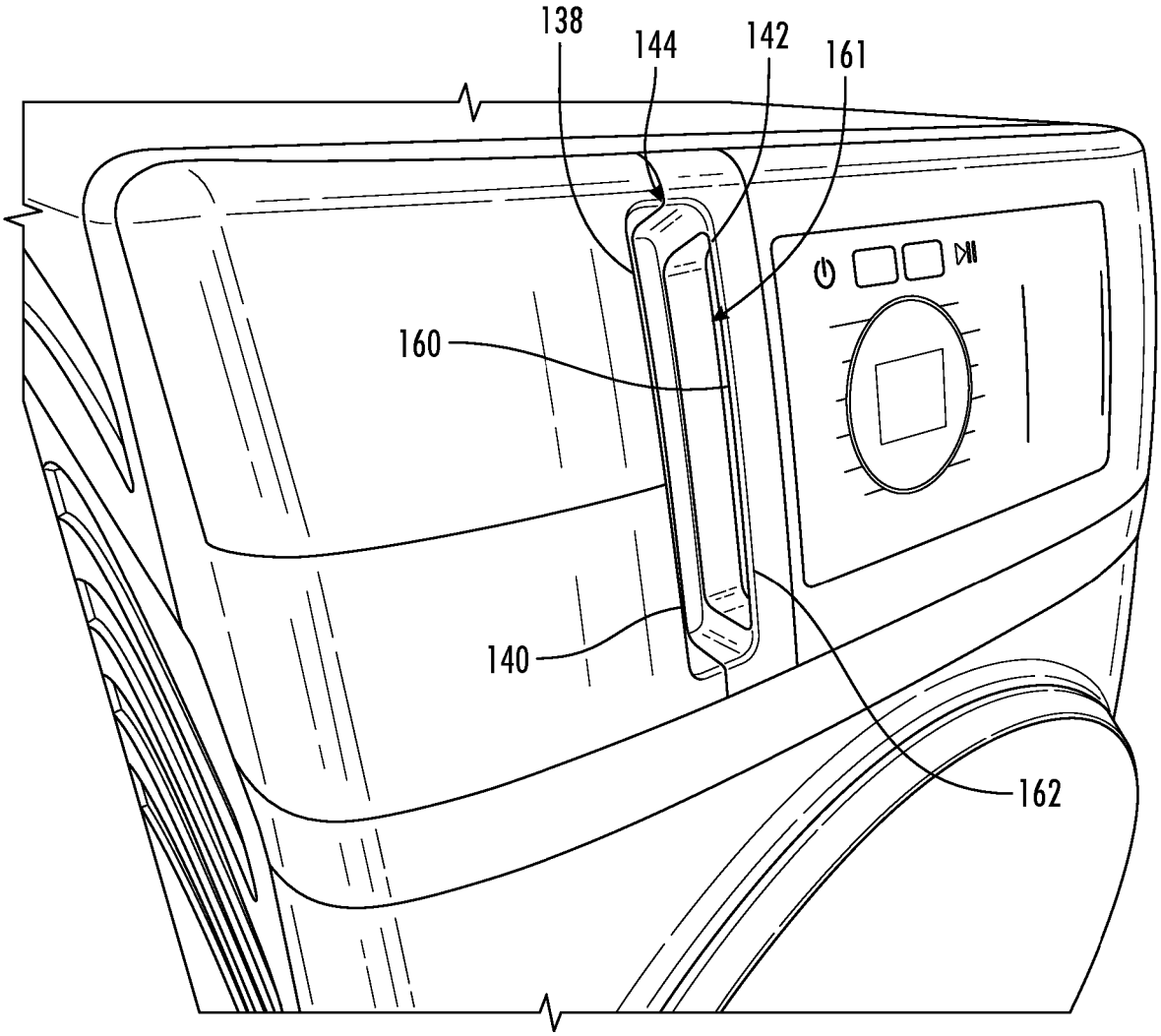
FIG. 4 provides a perspective view of the control panel of the laundry appliance of FIG. 1.

As shown perhaps best in FIGS. 2-4, first vertical edge 138 of first drawer 132 is aligned with second vertical edge 140 of second drawer 134 when each drawer is in a closed position as in FIGS. 2-4. Laterally spaced apart from first and second vertical edges 138, 140 is third vertical edge 142 of third drawer 136. The spaced apart vertical edges form a common recess area 144 between the stacked drawers 132, 134 and the third drawer 136. The common recess area 144 forms three gripping areas, or pocket handles, to grip the three drawers 132, 134, 136 individually.

Figure 5:
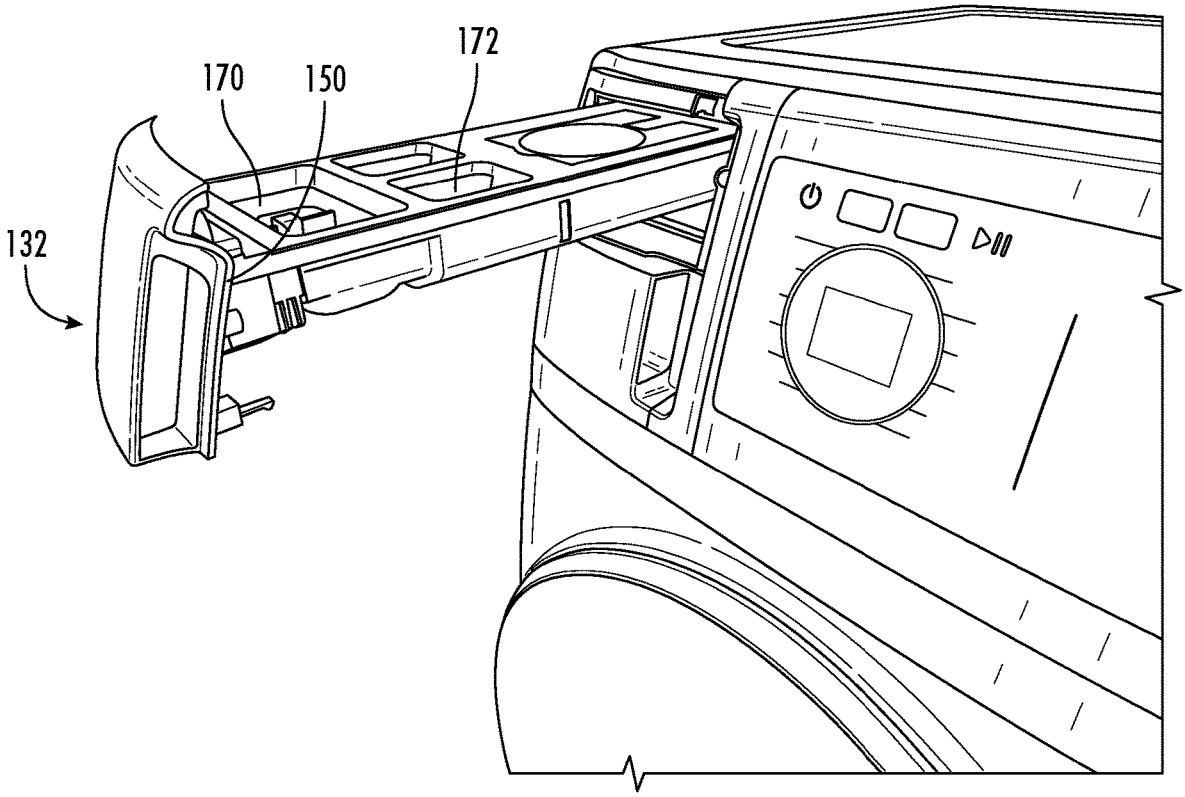
FIG. 5 provides a perspective view of a first drawer in an extended position in accordance with an embodiment of the present disclosure.

Specifically, the first vertical edge 138 of drawer 132 transitions into a first pocket handle 147 including a gripping surface 146, transversely T behind the first drawer front 148. As used in this disclosure, the vertical edges of the plurality of drawers is a point of inflection in the shape of the drawer such that the drawer defines a pocket to accept a user's finger or fingers to engage the drawer to facilitate sliding the drawer. First gripping surface 146 and first drawer front 148 may be parallel to each other, or first gripping surface 146 may follow a curvilinear path diverging from the first drawer front 148. First gripping surface 146 may terminate at generally vertical edge 150 as illustrated in FIGS. 2 and 5.

Figure 6:
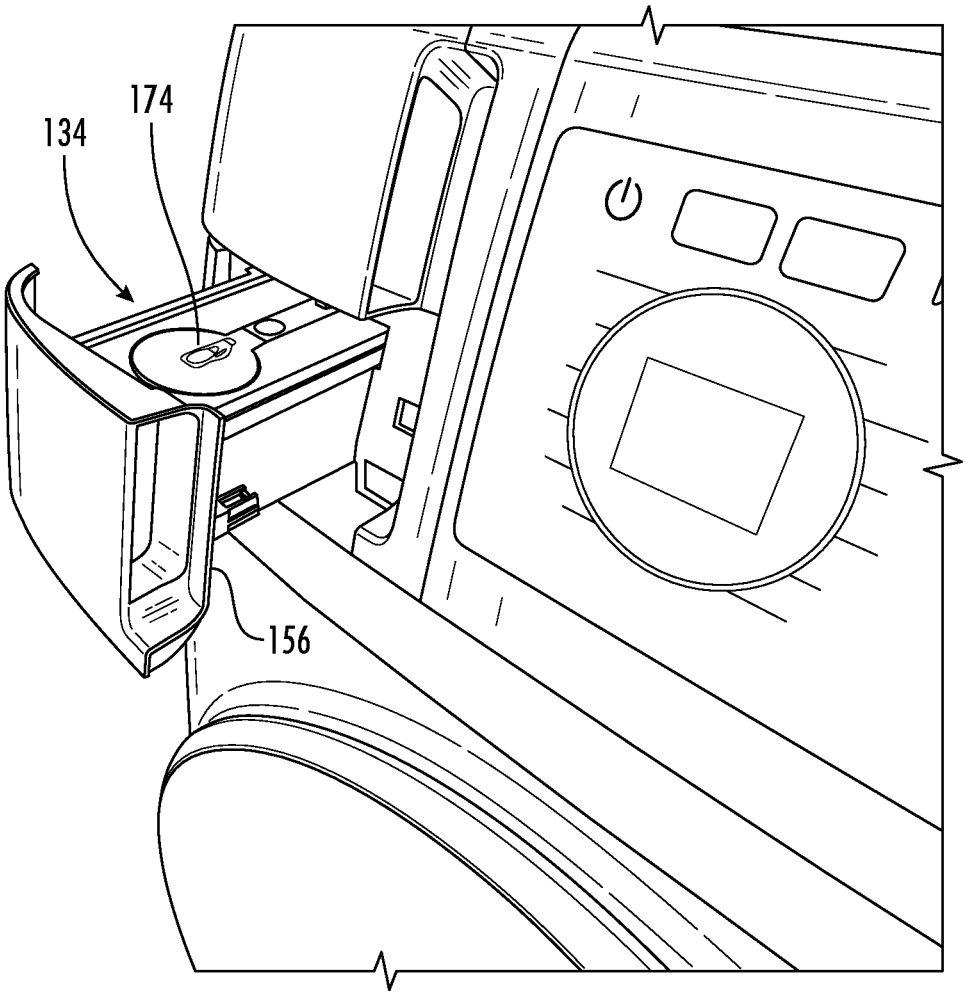
FIG. 6 provides a perspective view of a second drawer in an extended position in accordance with an embodiment of the present disclosure.

Similarly, the second vertical edge 140 of second drawer 134 may also transition into a second pocket handle 153 including a second gripping surface 152 transversely behind second drawer front 154. Second gripping surface 152 and second drawer front 154 may be parallel to each other, or second gripping surface 152 may follow a curvilinear path diverging from the second drawer front 154. Second gripping surface 152 may terminate at generally vertical edge 156 as illustrated in FIGS. 2 and 6. Vertical edges 150 and 156 may be vertically aligned, i.e., colinear and parallel to the vertical V direction, when the first and second drawers 132, 134 are in the close position as illustrated in FIGS. 1-4.

Figure 7:
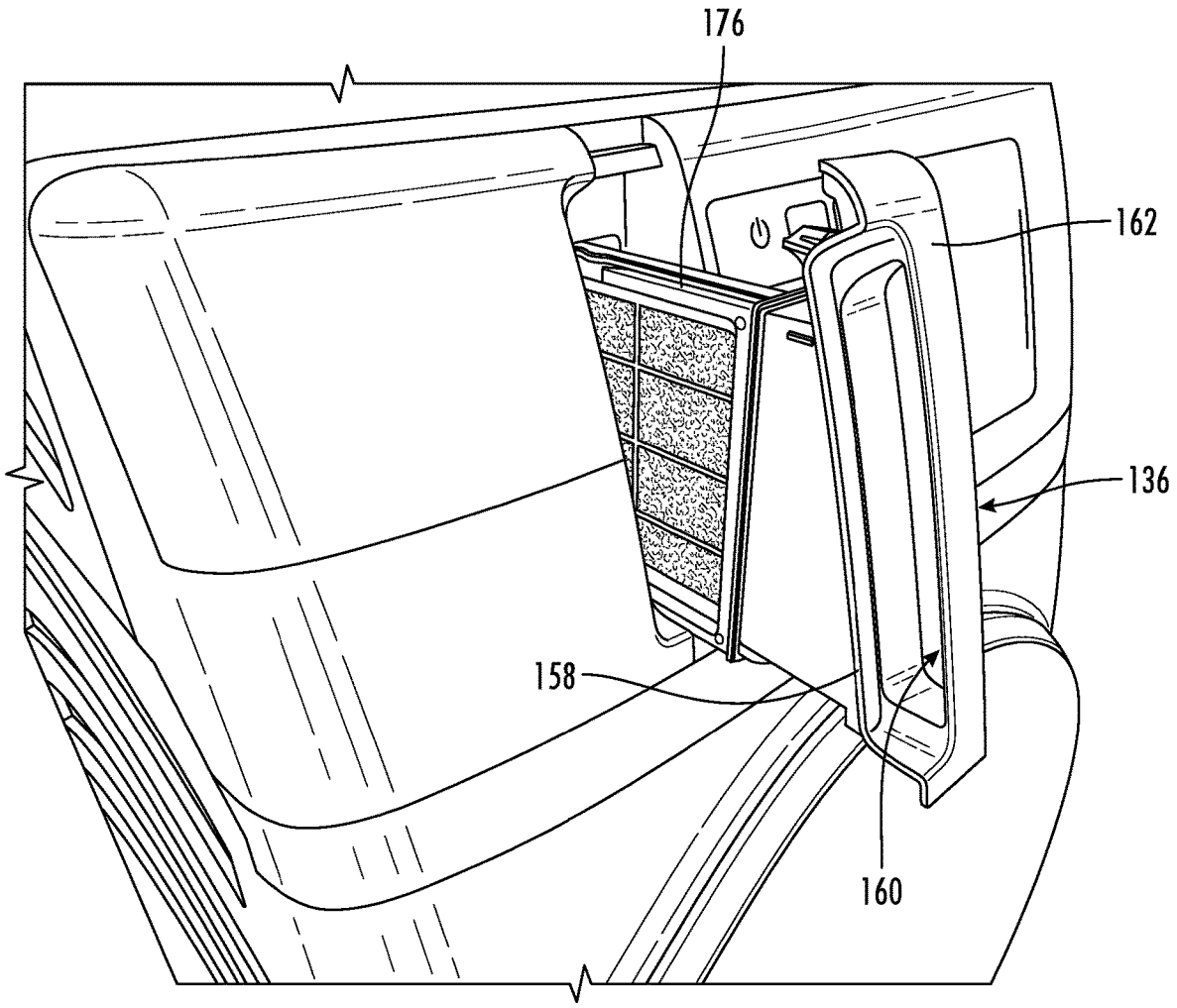
FIG. 7 provides a perspective view of a third drawer in an extended position in accordance with an embodiment of the present disclosure.

Similarly, third vertical edge 142 of third drawer 136 may also transition into a third pocket handle 161, including gripping surface 160 transversely behind third drawer front 162. Third gripping surface 160 and third drawer front 162 may be parallel to each other, or third gripping surface 160 may follow a curvilinear path diverging from the third drawer front 162. Third gripping surface 160 may terminate at generally vertical edge 158 as illustrated in FIG. 7. Vertical edges 150, 156, and 158 may be vertically aligned, i.e., parallel to the vertical V direction and abutting when first, second, and third drawers 132, 134, 136 are in the closed position as in FIGS. 1-4.

As may be best illustrated in FIGS. 3 and 7, the first, second and third gripping surfaces 146, 152, and 160 each form a pocket handle 147, 153, 161, respectively, with the pocket formed behind the first, second and third drawer fronts 148, 154, and 162, with the first, second, and third drawers 132, 134, and 136 each forming individual pockets. A user may grip each drawer individually, tactically identifying which drawer is gripped. For example, the first and second pocket doors 147, 153 are individually formed providing tactile confirmation, and third pocket handle 161 is laterally opposed from the other two.

In some embodiments, at least one of the stacked drawers 132, 134 is a dispenser drawer in that the drawer may hold a volume of laundry treatment or additive useful in processing laundry received in the drum (not shown). FIG. 5 is illustrative of a dispenser drawer, first drawer 132, comprising internal geometry defining one or more chambers for holding different volumes of laundry additive. For example, the internal geometry of the first drawer 132 defines first chamber 170 to accept a first volume of laundry additive. The first volume of first chamber 170 may be sufficient to treat one load of laundry processed in the tub. In some embodiments, a drawer, for example first drawer 132, may include a second internal geometry defining a second chamber 172 to accept a second volume of laundry additive. In some cases, second chamber 172 may be configured to accept a larger volume of additive than first chamber 170, for example sufficient volume to treat multiple laundry loads. For example, in the case of the second chamber 172 accepting laundry detergent, the second chamber 172 may be configured to accept 50 fluid ounces of liquid detergent. In the case of fabric softener, the second chamber may be sufficiently large to accept 32 fluid ounces of liquid softener.

FIG. 6 is illustrative of a second drawer 134 in accordance with the present disclosure. Second drawer 134 may include internal geometry defining a chamber, third chamber 174, configured to accept a volume of laundry additive. The volume may be sufficient for a single laundry load or for more than one laundry load. In some embodiments, the second drawer may be configured to hold dry laundry products or liquid products. In one embodiment, first drawer 132 may be configured to accept one laundry additive sufficient for multiple loads of laundry and the second drawer may be configured to hold a second laundry additive for a similar number of loads of laundry.

In embodiments in which laundry appliance 100 is a combination washer/dryer, third drawer 136 may include a lint filter 176 positioned to intercept the flow of drying air and remove dust and lint particles given off by the processed clothes. The third drawer 136 may be removed from the laundry appliance 100 for removal of collected lint particles. The removal of the third drawer may be facilitated by the pocket handle formed by third gripping surface 160.

Figure 8:
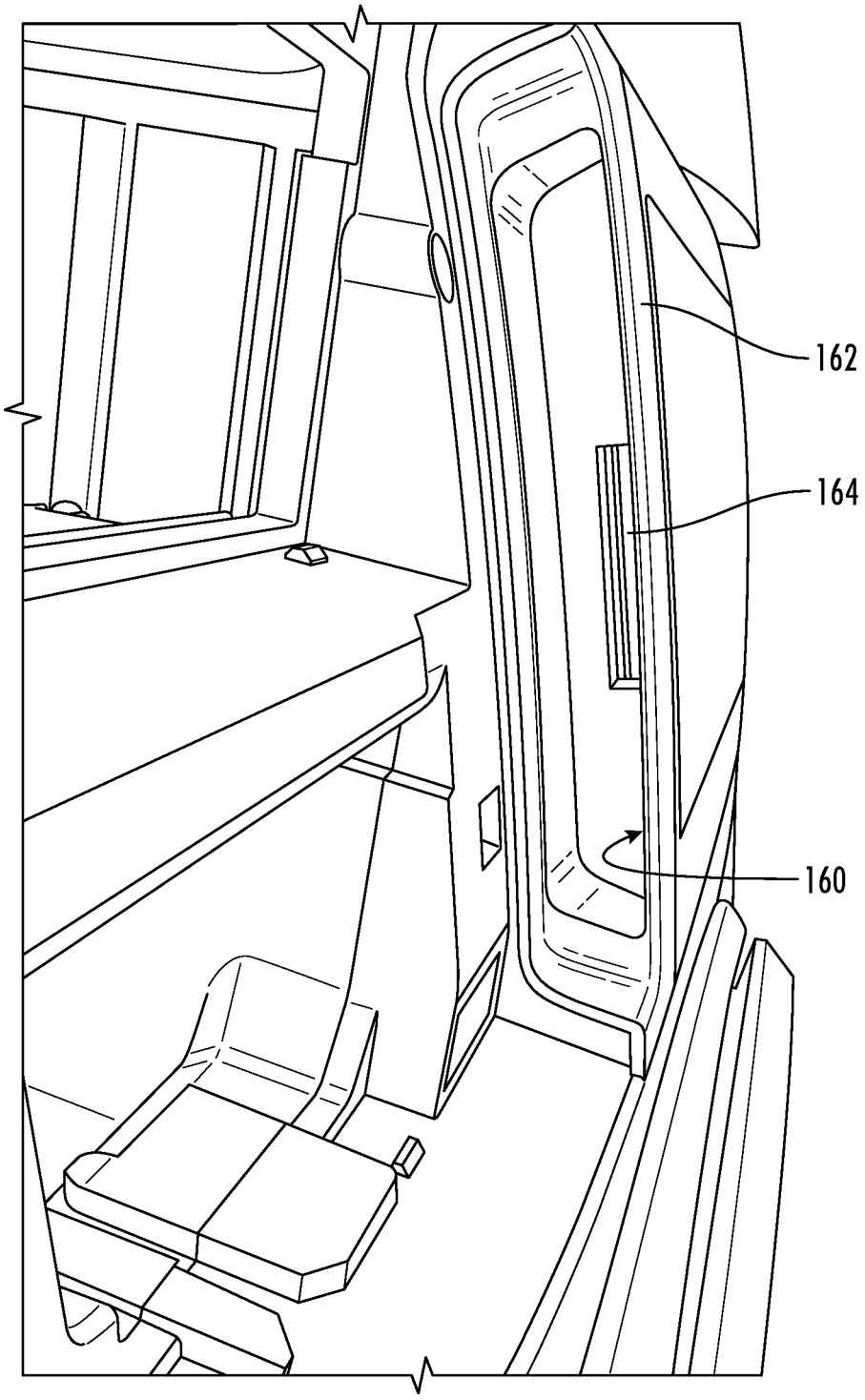
FIG. 8 provides a side perspective view of the third pocket handle in accordance with an embodiment of the present disclosure.

Pocket handle/gripping surface 160 includes an aperture 164 as best illustrated in FIG. 8. The aperture 164 aligns with one or more light sources 168, for example light emitting diodes (LEDs) arranged on the adjacent edge of user interface board 130. The light sources 168 are controlled by the user interface board 130 to emit light having predetermined characteristics. For example, the characteristics of the light sources 168 may include different colors of light, with the color corresponding to operating conditions of the laundry appliance 100 (for example operating or not, maintenance required, etc.). In some cases, the light sources may emit a particular color of light or pattern of emitted light to indicate a maintenance operation is required, for example cleaning of the lint filter 176. In other embodiments, the light color or pattern could indicate the level of one or more of the laundry additives is becoming low and requires user attention. A pattern, as a characteristic of light from the light sources 168, may include flashing or pulsing of one or more colors of light, cyclic displays of various colors or combinations of colors of light, or the like to signal a user to an operating condition of the laundry appliance. The emitted light from the light source(s) passes through the aperture 164 and illuminates a user visible surface 169 of the control panel 124, for example the opposing first and second gripping surfaces 146 and 152.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A horizontal axis laundry appliance defining a vertical direction, a lateral direction, and a transverse direction, the vertical, lateral, and transverse directions being mutually perpendicular, the horizontal axis laundry appliance comprising:

a cabinet comprising a front panel defining an opening;

a drum positioned within the cabinet and being accessible through the opening;

a door mounted to the cabinet and movable between an open position and a closed position to provide selective access to the drum through the opening;

a control panel mounted to a front of the cabinet; and a drawer assembly positioned adjacent to the control panel, the drawer assembly comprising a plurality of drawers, the drawer assembly further comprising:

at least a first drawer and a second drawer of the plurality of drawers stacked in the vertical direction, the first drawer stacked atop the second drawer, the first drawer of the stacked drawers defining a first vertical edge and the second drawer of the stacked drawers defining a second vertical edge; and at least a third drawer of the plurality of drawers positioned between the stacked drawers and the control panel, the third drawer defining a third vertical edge spaced apart from the first vertical edge and the second vertical edge, wherein the first drawer comprises a first pocket handle, the second drawer comprises a second pocket handle, and the third drawer comprises a third pocket handle, wherein the first pocket handle, the second pocket handle, and the third pocket handle collectively define a common recessed handle area.

2. The horizontal axis laundry appliance of claim 1, wherein the first vertical edge transitions into the first pocket handle with a first gripping surface at least partially transversely behind a first drawer front and the second vertical edge transitions into the second pocket handle with a second gripping surface at least partially behind a second drawer front.

3. The horizontal axis laundry appliance of claim 2, wherein the third vertical edge transitions into the third pocket handle with a gripping surface at least partially transversely behind a third drawer front.

4. The horizontal axis laundry appliance of claim 3, wherein the control panel includes a user interface board mounted to an inner surface of the front panel, wherein the user interface board includes one or more light sources positioned on an edge adjacent to the third drawer of the plurality of drawers.

5. The horizontal axis laundry appliance of claim 4, wherein the third pocket handle includes an aperture aligned with the one or more light sources, the one or more light sources controlled by the user interface board to emit light through the aperture to illuminate a user visible surface.

6. The horizontal axis laundry appliance of claim 5, wherein the user visible surface includes at least part of one of the first and second pocket handles.

7. The horizontal axis laundry appliance of claim 5, wherein characteristics of the light indicate operating conditions of the horizontal axis laundry appliance.

8. The horizontal axis laundry appliance of claim 7, wherein a color of the light corresponds to a maintenance requirement.

9. The horizontal axis laundry appliance of claim 1, wherein at least one of the stacked drawers is a dispenser drawer comprising an interior geometry defining a first chamber to accept a first volume of laundry additive.

10. The horizontal axis laundry appliance of claim 9, wherein the first chamber dispenses the first volume of laundry additive in one laundry load.

11. The horizontal axis laundry appliance of claim 9, wherein the interior geometry further defines a second chamber to accept a second volume of laundry additive.

12. The horizontal axis laundry appliance of claim 11, wherein the second chamber dispenses a portion of the second volume in multiple laundry loads.

13. The horizontal axis laundry appliance of claim 1, wherein the third drawer of the plurality of drawers is a lint filter.

14. The horizontal axis laundry appliance of claim 1, wherein the horizontal axis laundry appliance is a washing machine.

15. The horizontal axis laundry appliance of claim 1, wherein the horizontal axis laundry appliance is a combination washing machine and dryer.

16. A front panel for a laundry appliance, the front panel comprising:

an inner surface and an opposite outer surface;

a control panel on the front panel; and a drawer assembly positioned adjacent to the control panel, the drawer assembly comprising a plurality of drawers, the drawer assembly further comprising:

at least a first drawer and a second drawer of the plurality of drawers stacked in a vertical direction, the first drawer stacked atop the second drawer, the first drawer of the stacked drawers defining a first vertical edge and the second drawer of the stacked drawers defining a second vertical edge; and at least a third drawer of the plurality of drawers positioned between the stacked drawers and the control panel, the third drawer defining a third vertical edge spaced apart from the first vertical edge and the second vertical edge, wherein the first drawer comprises a first pocket handle, the second drawer comprises a second pocket handle, and the third drawer comprises a third pocket handle, wherein the first pocket handle, the second pocket handle, and the third pocket handle collectively define a common recessed handle area.

17. The front panel of claim 16, wherein:

the first vertical edge transitions into the first pocket handle with a first gripping surface at least partially transversely behind a first drawer front;

the second vertical edge transitions into the second pocket handle with a second gripping surface at least partially behind a second drawer front; and the third vertical edge transitions into the third pocket handle with a gripping surface at least partially transversely behind a third drawer front.

18. The front panel of claim 17, further comprising:

a user interface board mounted to the inner surface of the front panel, the user interface board including one or more light sources positioned on an edge adjacent to the third drawer of the plurality of drawers; and an aperture in the third pocket handle aligned with the one or more light sources, the one or more light sources controlled by the user interface board to emit light through the aperture to illuminate a user visible surface; and wherein characteristics of the light indicate operating conditions of the laundry appliance.

19. The front panel of claim 16, wherein at least one of the stacked drawers is a dispenser drawer comprising an interior geometry defining a first chamber to an accept a first volume of laundry additive and the interior geometry further defines a second chamber to accept a second volume of laundry additive.

20. The front panel of claim 16, wherein the third drawer of the plurality of drawers is a lint filter.

* * * * *